US008668177B2

(12) United States Patent
Stein et al.

(10) Patent No.: US 8,668,177 B2
(45) Date of Patent: Mar. 11, 2014

(54) COMBINATION PURSE HANGER AND OBJECT RETAINER

(75) Inventors: Sandra Stein, West Hills, CA (US); Jennifer J. Jenkins, Newhall, CA (US)

(73) Assignee: The Finding IP Holding Company LLC, West Hills, CA (US)

( * ) Notice: Subject to any disclaimer, the term of this patent is extended or adjusted under 35 U.S.C. 154(b) by 0 days.

(21) Appl. No.: 13/586,600

(22) Filed: Aug. 15, 2012

(65) Prior Publication Data

US 2014/0042287 A1 Feb. 13, 2014

Related U.S. Application Data

(60) Provisional application No. 61/681,595, filed on Aug. 9, 2012.

(51) Int. Cl.
*F16B 45/00* (2006.01)

(52) U.S. Cl.
USPC ..... 248/308; 248/914

(58) Field of Classification Search
USPC ..... 248/215, 304–306, 308, 341; 223/DIG. 4, 85, 88, 120; D3/328
See application file for complete search history.

(56) References Cited

U.S. PATENT DOCUMENTS

| | | | | |
|---|---|---|---|---|
| 3,630,475 | A * | 12/1971 | Barry | 248/215 |
| 5,094,417 | A * | 3/1992 | Creed | 248/215 |
| 5,458,301 | A * | 10/1995 | Cournoyer | 248/95 |
| 7,350,756 | B2 * | 4/2008 | Woltmann et al. | 248/303 |
| 7,828,258 | B2 * | 11/2010 | Shigio et al. | 248/308 |
| 7,837,171 | B1 * | 11/2010 | Otake | 248/339 |
| 8,083,202 | B1 * | 12/2011 | Hutchison | 248/691 |
| 8,371,546 | B2 * | 2/2013 | Bauerly | 248/304 |

* cited by examiner

*Primary Examiner* — Gwendolyn Baxter
(74) *Attorney, Agent, or Firm* — Morgan, Lewis & Bockius LLP

(57) ABSTRACT

An apparatus comprising first and second elements and a connecting element is provided. The first element comprises a first terminal member, an intermediate member having first and second ends, and a second terminal member having a closed form channel. The connecting element goes through the channel thereby engaging the first and second elements. An axis connects the first terminal member and the intermediate member first end permitting a closed position, in which the first terminal member adjoins the intermediate member, and an open position, in which the first terminal member is away from the intermediate member. Another axis connects the second terminal member and the intermediate member second end permitting a closed position, in which the second terminal member adjoins the intermediate member, and an open position, in which the second terminal member is away from the intermediate member. The second element retains an object.

32 Claims, 12 Drawing Sheets

COMBINATION PURSE HANGER AND OBJECT RETAINER

CROSS-REFERENCE TO RELATED APPLICATION

The present application claims the benefit of U.S. Provisional Patent Application 61/681,595 filed Aug. 9, 2012, which is incorporated by reference in its entirety for all purposes.

FIELD OF THE DISCLOSURE

The present disclosure relates to a combination purse hanger and object retainer. The combination purse hanger and object retainer is used to facilitate the ready location of objects in a purse, backpack, briefcase or like bag and also to support such purse, backpack, briefcase or like bag from a surface, such as a table surface.

BACKGROUND

A common and popular type of purse or like bag has a top that includes at least a region that is upwardly open in use. Often this type of bag is rather deep, permitting the owner-user to store a variety of items. Further, such depth is generally considered fashionable. A known drawback of the above-described purse or like bag configuration resides in the difficulty of readily retrieving objects, such as keys, pens, flashlights, magnifying glasses, eye pieces, coin purses, USB keys, key fobs (security token), access card keys, fast passes, credit cards, bank cards or a group thereof gathered on a chain or other retention device, from its interior. This can lead to the frustration of the owner-user and to others. For example, the difficulty of locating car keys at the bottom of a purse can cause significant delay in vacating a parking space. A useful apparatus that addresses the problem of finding keys is the novel ALEXX FINDERS KEY PURSE. The ALEXX FINDERS KEY PURSE is described in U.S. Pat. Nos. 7,537,032; 7,308,922; and D539,526, which are hereby incorporated by reference.

While the ALEXX FINDERS KEY PURSE is an outstanding product in its own right, the FINDERS KEY PURSE does not protect the purse or like bag, and is specifically directed to the retention of keys. To illustrate the limitations of the ALEXX FINDERS KEY PURSE, consider the problem posed when dining at a restaurant. Often, the only location to place the purse or like bag is under a chair, where it can easily be damaged by accidental trampling, or soiled because it is on the floor. Moreover, such a location for the bag is not secure because it not visible to the owner, and thus is susceptible to being lost or stolen. Because of the high costs of purses and like bags, it would be desirable to have a device that not only acts as a key locator, like the ALEXX FINDERS KEY PURSE, but further protects the purse or like bag when the purse or like bag is not being carried and further can be used to retain other objects besides just keys.

Given the above importance of the above identified objectives, what are needed in the art are improved apparatus for holding and storing objects such as keys and for protecting purses and like bags when such purses and like bags are not in use.

SUMMARY

The present disclosure addresses the preceding and other shortcomings of the prior art by providing an apparatus that is a combination purse hanger and object retainer. When the purse is in use, the combination purse hanger and object retainer is used to store objects using an edge (e.g., side pocket or main zipper portion) of the bag. The combination purse hanger and object finder hangs from the edge with the objects inside the bag. In this way, the objects are easily located. When the purse is not in use, but rather needs to be stored in a safe and clean location, the combination purse hanger and object retainer is retrieved from the bag, opened up, and used to hang the bag from a surface, such as a table top. In this way, the bag is not soiled, lost or stolen.

One aspect of the present disclosure provides a combination purse hanger and object retainer comprising first and second elements and a connecting element (e.g., first ring, a chain or string drawn) that connects the first and second elements. The first element comprises i) a first terminal member having an end portion, ii) an intermediate member having a first end and a second end and iii) a second terminal member having a closed form channel. The second element is configured for selectively retaining at least one object. Exemplary objects include, but are not limited to keys, combs, brushes, cosmetics, pens, flashlights, magnifying glasses, eye pieces, coin purses, USB keys, key fobs, access card keys, fast passes, credit cards, and bank cards. The connecting element is drawn through the closed form channel and substantially permanently and flexibly engages the second element to the first element. The first terminal member and the first end of the intermediate member are connected by a first swivel axis thereby defining a first interior region between the first terminal member and the first end of the intermediate member. The first swivel axis permits the first terminal member to swivel between (i) a first closed position in which the first terminal member adjoins a first side of the intermediate member and (ii) a first open position in which the first terminal member is swiveled away from the first side of the intermediate member. The second terminal member and the second end of the intermediate member are connected by a second swivel axis thereby defining a second interior region between the second terminal member and the second end of the intermediate member. The second swivel axis permits the second terminal member to swivel between (i) a second closed position, in which the second terminal member adjoins a second side of the intermediate member, to (ii) a second open position, in which the second terminal member is swiveled away from the second side of the intermediate member. The first side opposes the second side. The first terminal member and the first end of the intermediate member are configured to allow the first interior region to hang from or clasp an edge when the first swivel axis is in the first closed position. The first terminal member and the first end of the intermediate member are configured to allow the first terminal member to engage a surface when the first swivel axis is in the first open position, thereby supporting the combination purse hanger and object finder. The second terminal member and the second end of the intermediate member are configured to allow the second interior region to support a hanging bag or purse when the second swivel axis is in the second closed position. The end portion of the first terminal member is affixed to a container, flashlight or ornament.

The preceding and other features of the invention will become further apparent from the detailed description that follows. Such description is accompanied by a set of drawing figures. Numerals of the drawing figures correspond to numerals of the written description with like numerals referring to like features throughout both the written description and the drawing figures.

BRIEF DESCRIPTION OF THE DRAWINGS

Like reference numerals refer to corresponding parts throughout the several views of the drawings.

DETAILED DESCRIPTION

Figure 1:
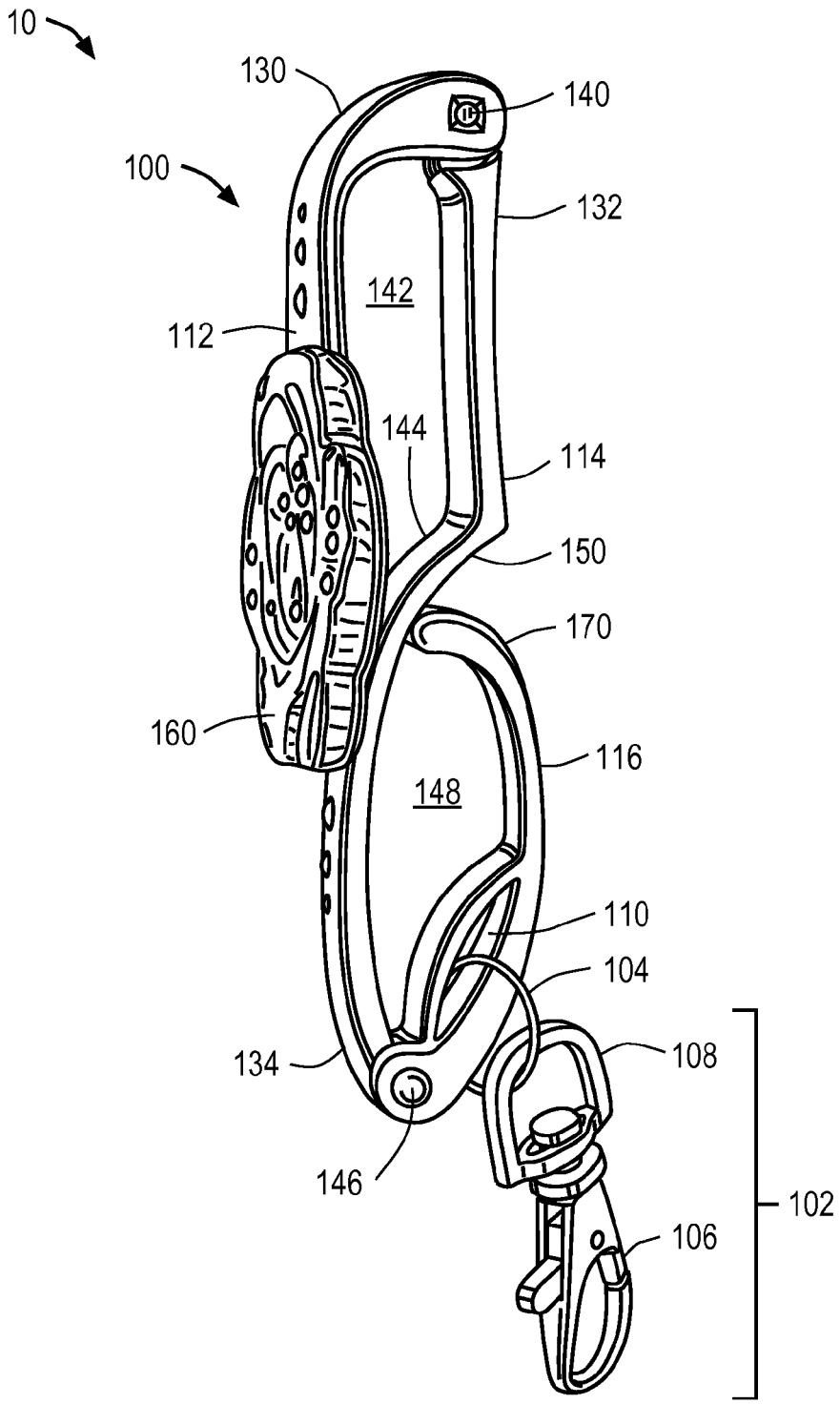
FIG. 1 is a front perspective view of a first combination purse hanger and object retainer in accordance with an embodiment of the present disclosure.

Turning now to the drawings, FIG. 1 is a front perspective view of the combination purse hanger and object finder 10 of the present disclosure. The combination purse hanger and object finder 10 comprises a first element 100, a second element 102 and a connecting element (e.g., ring, chain or string) 104. In some embodiments, the first element 100 and second element 102 are each independently made of steel, or other metal, a plastic, or other rigid elastomeric material. In some embodiments, the first element 100 and second element 102 each independently comprise gold, silver, steel, nickel, aluminum, an alloy thereof, or any combination thereof. In some embodiments, the first element 100 and the second element 102 are each made of metal.

In some embodiments, the first element 100 and/or second element 102 comprises urethane polymer, an acrylic polymer, a fluoropolymer, polybenzamidazole, polyimide, polytetrafluoroethylene, polyetheretherketone, polyamide-imide, glass-based phenolic, polystyrene, cross-linked polystyrene, polyester, polycarbonate, polyethylene, polyethylene, acrylonitrile-butadiene-styrene, polytetrafluoro-ethylene, polymethacrylate, nylon 6,6, cellulose acetate butyrate, cellulose acetate, rigid vinyl, plasticized vinyl, or polypropylene. In some embodiments, all or a portion of the first element 100 and/or second element 102 is electroplated.

As illustrated in FIG. 1, the first element comprises a first terminal member 112, an intermediate member 114, and a second terminal member 116.

In the embodiment shown in FIG. 1, the second element 102 includes a clasp 106 that, in some embodiments, is rotatably engaged to an inverted u-shaped element 108. It will be appreciated that clasp 106 is an exemplary way to retain objects. For example, in some alternative embodiments, rather than a clasp 106, a key ring is used in the place of clasp 106.

In the embodiment illustrated in FIG. 1, the u-shaped element 108 is arranged to engage the connecting element 104 which, in turn, is drawn through a closed form channel 110, formed in second terminal member 116 of the first element, in order to substantially permanently and flexibly engage the second element 102 to the first element 100.

In some embodiments, the clasp 106, key ring, or other retention device is used to hold one or more objects. In some embodiments, such objects are keys, pens, flashlights, magnifying glasses, eye pieces, coin purses, USB keys, key fobs, access card keys, fast passes, credit cards, bank cards, a Chick Sac®, or a group thereof. In the case of USB keys, key fobs, access card keys, fast passes, credit cards, bank cards and the like, such objects may be mounted in a carrier which, in turn, is fastened to a closed form channel 110.

Figure 8A:
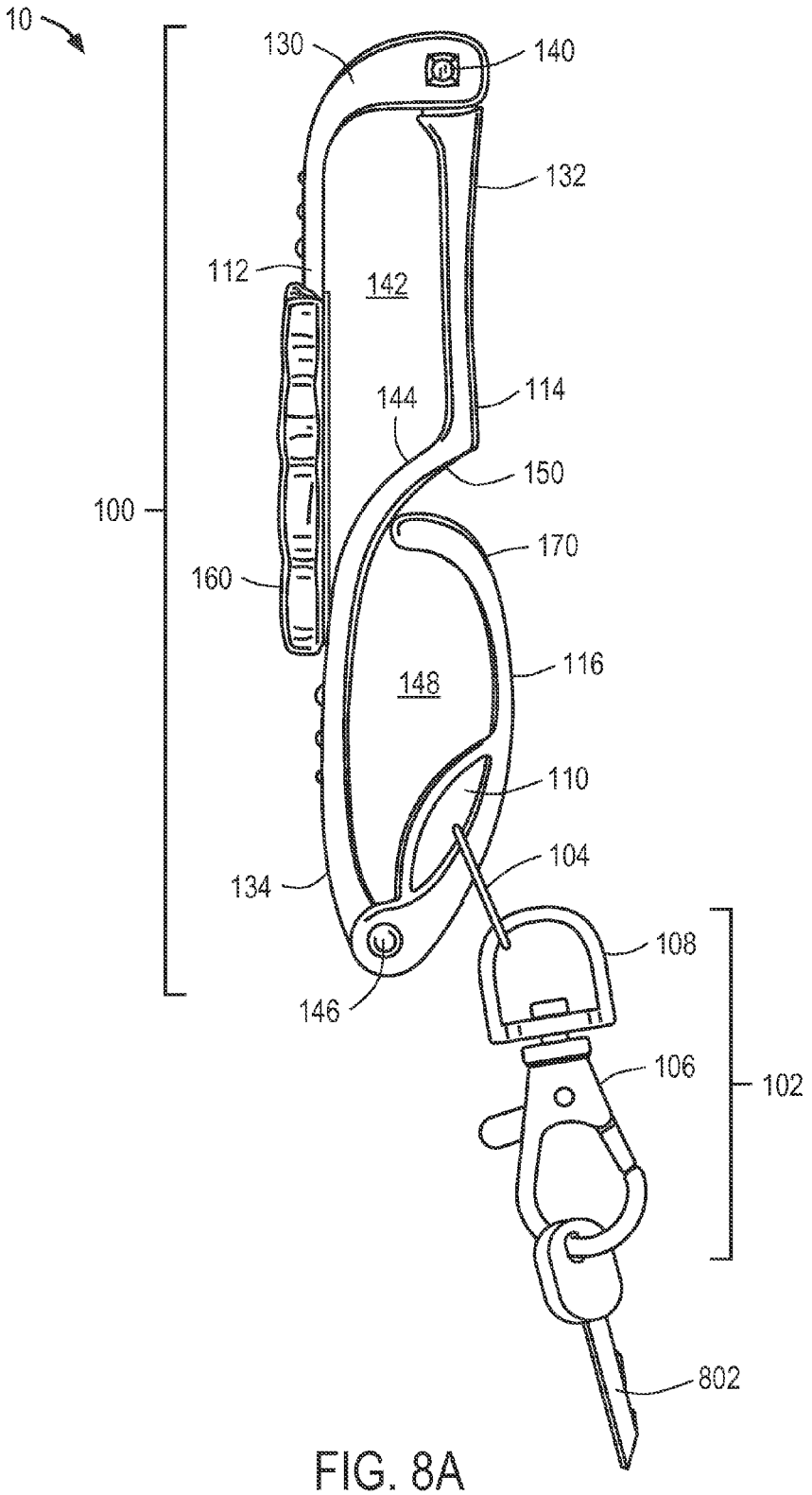
FIG. 8A shows an exemplary representation of an object retained on the second element in a form of a key.
Figure 8B:
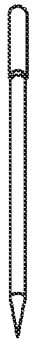
FIG. 8B shows an exemplary representation of an object in a form of a pen.
Figure 8C:
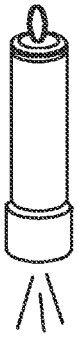
FIG. 8C shows an exemplary representation of an object in a form of a flashlight.
Figure 8D:
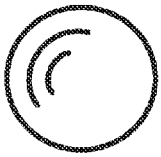
FIG. 8D shows an exemplary representation of an object in a form of a magnifying glass.
Figure 8E:
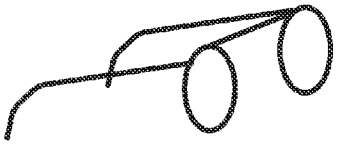
FIG. 8E shows an exemplary representation of an object in a form of an eye piece.
Figure 8F:
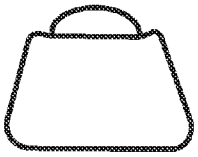
FIG. 8F shows an exemplary representation of an object in a form of a coin purse.
Figure 8G:
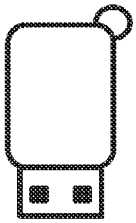
FIG. 8G shows an exemplary representation of an object in a form of a USB key.
Figure 8H:
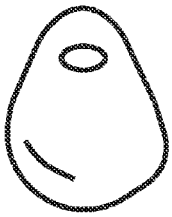
FIG. 8H shows an exemplary representation of an object in a form of a key fob.
Figure 8I:
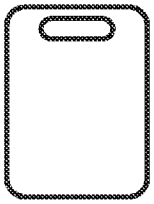
FIG. 8I shows an exemplary representation of an object in a form of an access card key.
Figure 8J:
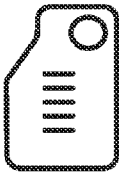
FIG. 8J shows an exemplary representation of an object in a form of a fast pass.
Figure 8K:
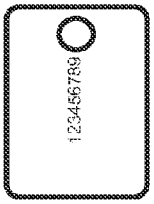
FIG. 8K shows an exemplary representation of an object in a form of a credit card.
Figure 8L:
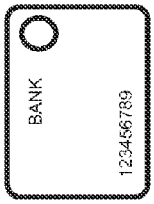
FIG. 8L shows an exemplary representation of an object in a form of a bank card.

FIG. 8A shows an exemplary representation of an object retained on the second element 102 in a form of a key 802. FIGS. 8B-8L show various other exemplary representations of an object, for example, in a form of a pen, a flashlight, a magnifying glass, an eye piece, a coin purse, a USB key, a key fob, an access card key, a fast pass, a credit cards, and a bank card, respectively.

In some embodiments, the connecting element 104 is wire rope such as any suitable wire rope in *Marks' Standard Handbook for Mechanical Engineers*, Ninth Edition, McGraw Hill, Inc., New York, 1987, eds. Avallone and Baumeister, pages 8-80 through 8-86, which is hereby incorporated by reference. In some embodiments, the connecting element 104 is a box chain comprising a continuous linking of interconnected six-sided, three-dimensional, miniature boxes. In some embodiments, the connecting element 104 is a curb chain comprising flat, interlocking, similar links. In some embodiments, the connecting element 104 is a cable chain comprised of oval interlocking links with alternating links turned 180°. In some embodiments, the connecting element 104 is a figaroa chain which comprises a combination of three curb links followed by an oval cable link and has a repeating pattern. In some embodiments, the connecting element 104 is a marina chain that has interlocking oval links whose width is bisected by a bar. In some embodiments, the connecting element 104 is a rope chain is made of twisted and braided fibers.

One of skill in the art will appreciate that there are numerous other methods by which elements 100 and 102 can be flexibly engaged, and thus other types of connecting elements 104. For example, the connecting element 104 can be a set of interlocking rings where a first ring in the set of interlocking rings is drawn through closed form channel 110 whereas a second ring in the set of interlocking rings engages u-shaped element 108. The first and second ring may interlock or there may be any number of interlocking rings between the first and second ring. In still another example, the connecting element is a closed form (not shown) that is both (i) drawn through closed form channel 110 and (ii) engages u-shaped element 108. The closed form may indeed be the shape of a ring or some other shape such as an oval but the disclosure is not so limited. Any closed form, such as a polygon, star-shape, or the like can be used to interlock closed form channel to u-shaped element 108. In still another example, the connecting element 104 comprises a set of interlocking closed forms where a first closed form in the set of interlocking closed forms is drawn through closed form channel 110 whereas a second closed form in the set of interlocking closed forms engages u-shaped element 108. The first and second closed forms may interlock themselves or, alternatively, there may be any number of interlocking closed forms between the first and second closed form elements. Such closed forms can be made out of, for example, metal, plastic, or wood.

Figure 6A:
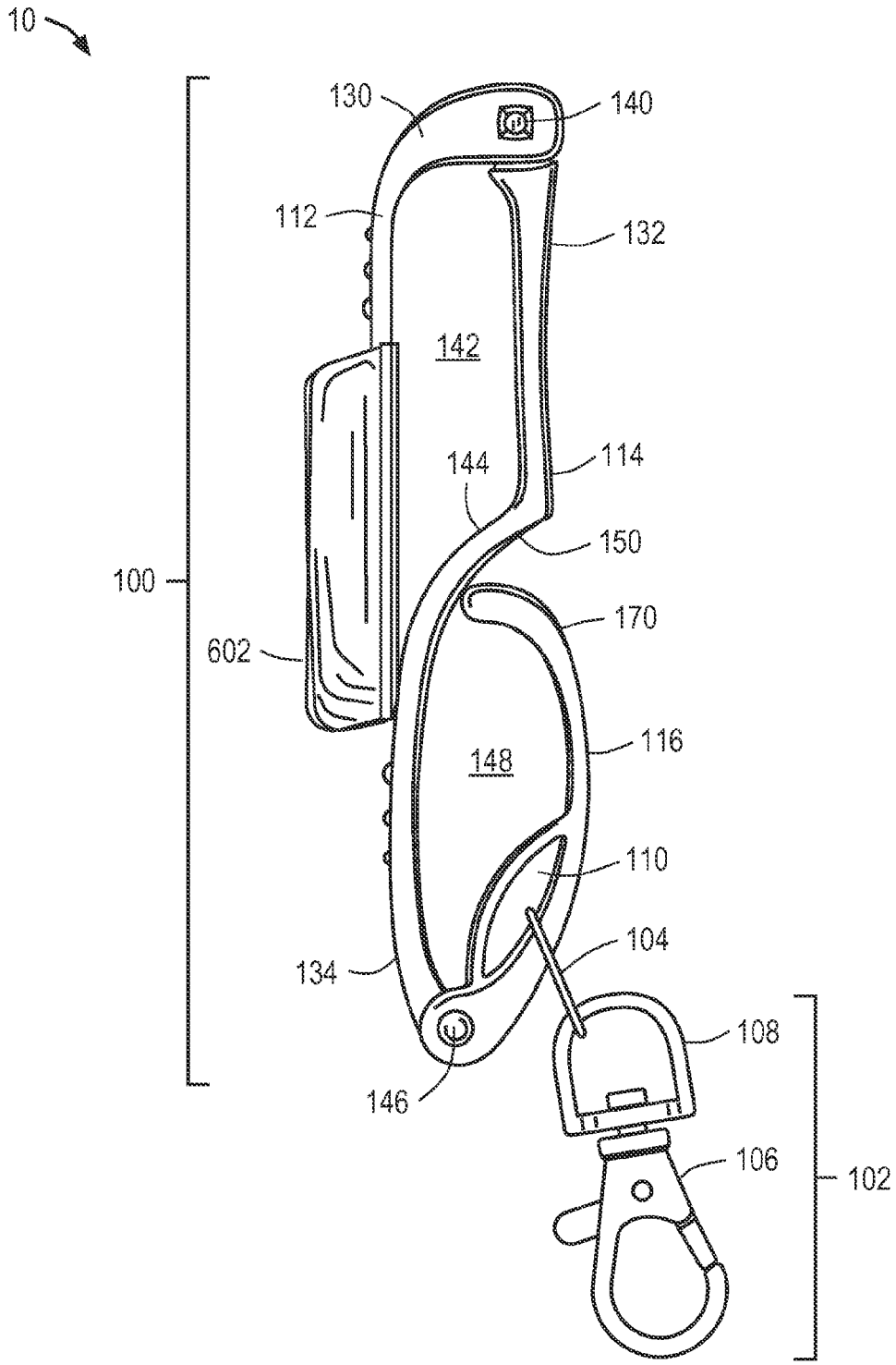
FIG. 6A shows an exemplary representation of the end portion of the first terminal member affixed to a container.
Figure 6B:
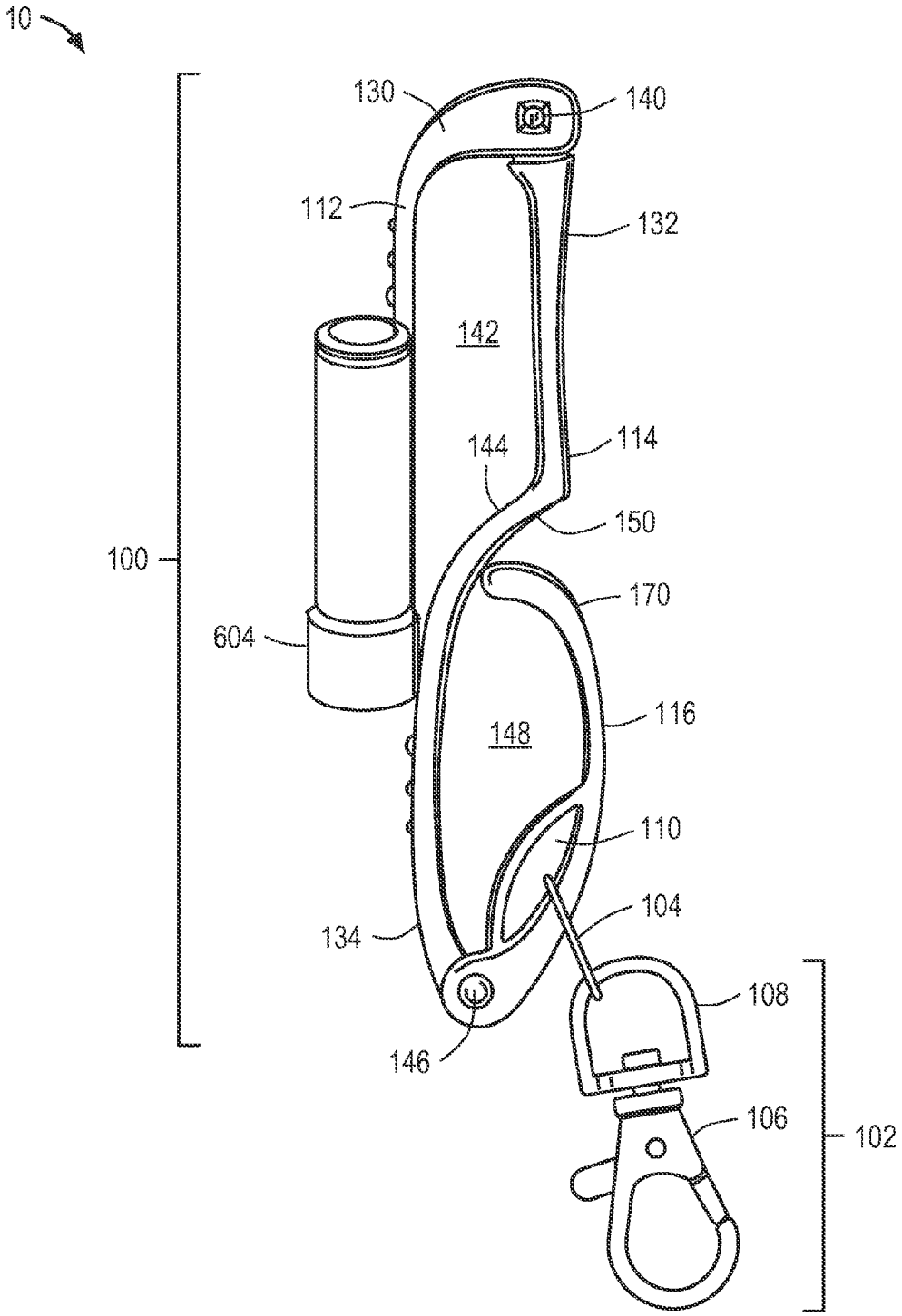
FIG. 6B shows an exemplary representation of the end portion of the first terminal member affixed to a flashlight.

FIG. 1 shows an exemplary representation of the end portion 130 of the first terminal member 112 affixed to an ornament 160. FIG. 6A shows an exemplary representation of the end portion 130 of the first terminal member 112 affixed to a container 602. FIG. 6B shows an exemplary representation of the end portion 130 of the first terminal member 112 affixed to a flashlight 604.

Figure 7A:
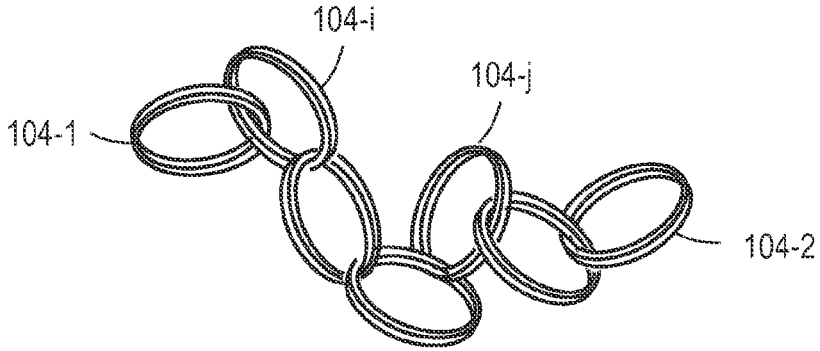
FIG. 7A shows an exemplary representation of a connecting element having a plurality of interlocking closed forms in ring shapes.
Figure 7B:
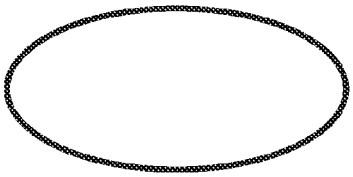
FIG. 7B shows an exemplary representation of a closed form having an oval shape.
Figure 7C:
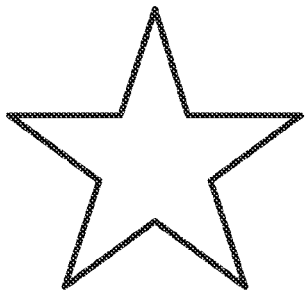
FIG. 7C shows an exemplary representation of a closed form having a star shape.
Figure 7D:
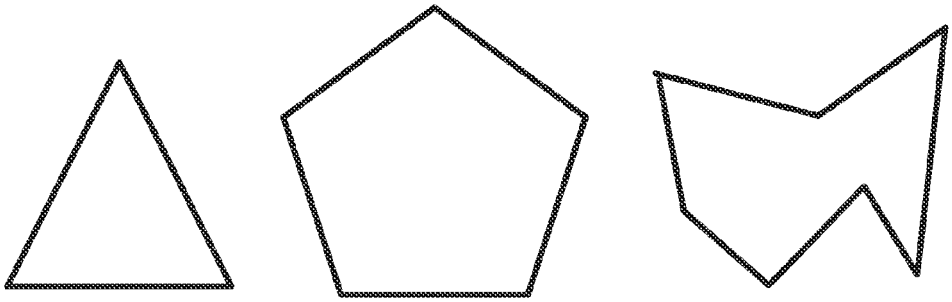
FIG. 7D shows exemplary representations of a closed form having polygon shapes.

FIG. 7A shows an exemplary representation of a connecting element 104 having a plurality of interlocking closed forms, such as 104-1, 104-2, **104-*i* and 104-*j*, in ring shapes. FIGS. 7B-7**D show exemplary representations of a closed form having an oval shape, a star shape, and polygon shapes, respectively.

It will be appreciated that u-shaped element 108 is just one example of a way to flexibly engage elements 100 and 102. For example, rather than having a u-shaped element 108, a pivoting element can be used to flexibly engage elements 100 and 102.

In one aspect, referring to FIG. 1, a combination purse hanger and object finder comprises a first element 100, the first element comprising i) a first terminal member 112 having an end portion 130, ii) an intermediate member 114 having a first end 132 and a second end 134, and iii) a second terminal member 116 having a closed form channel 110. The combination purse hanger and object finder further comprises B) a second element 102 configured for selectively retaining at least one key. The combination purse hanger and object finder further comprises C) a connecting element 104 drawn through the closed form channel 110 and substantially permanently and flexibly engaging the second element 102 to the first element 100. The first terminal member 112 and the first end 132 of the intermediate member 114 are connected by a first swivel axis 140 thereby defining a first interior region 142 between the first terminal member and the first end of the intermediate member. The first swivel axis 140 permits the first terminal member 112 to swivel between (i) a first closed position in which the first terminal member adjoins a first side 144 of the intermediate member and (ii) a first open position in which the first terminal member is swiveled away from the first side of the intermediate member. The second terminal member 116 and the second end 132 of the intermediate member 114 are connected by a second swivel axis 146 thereby defining a second interior region 148 between the second terminal member and the second end of the intermediate member. The second swivel axis 146 permits the second terminal member 116 to swivel between (i) a second closed position in which the second terminal member adjoins a second side 150 of the intermediate member to (ii) a second open position in which the second terminal member is swiveled away from the second side of the intermediate member. The first side 144 of the intermediate member 114 opposes the second side 150 of the intermediate member. The first terminal member 112 and the first end 132 of the intermediate member 114 are configured to allow the first interior region 142 to hang from or clasp an edge (not shown) when the first swivel axis 140 is in the first closed position. The first terminal member 112 and the first end 132 of the intermediate member 114 are configured to allow the first terminal member to engage a surface (not shown) when the first swivel axis 140 is in the first open position, thereby supporting the combination purse hanger and object finder 10. The second terminal member 116 and the second end of the intermediate member are configured to allow the second interior region to support a hanging bag or purse when the second swivel axis is in the second closed position. The end portion 130 of the first terminal member 112 is affixed to a container, flashlight or ornament 160.

Figure 2:
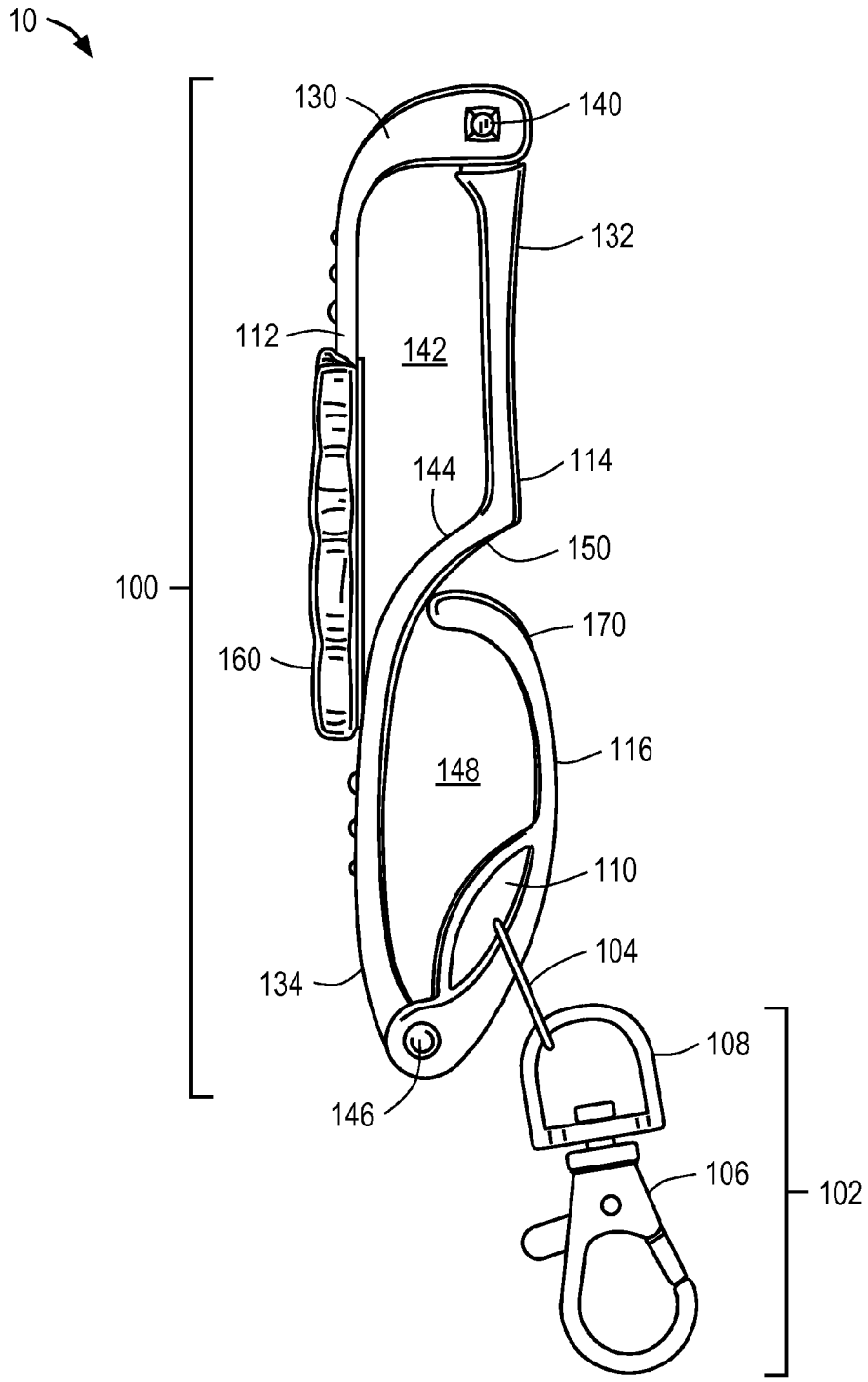
FIG. 2 is a side view of the combination purse hanger and object retainer of FIG. 1 in accordance with an embodiment of the present disclosure.

FIG. 2 illustrates a side view of the combination purse hanger and object finder of FIG. 1.

Figure 3:
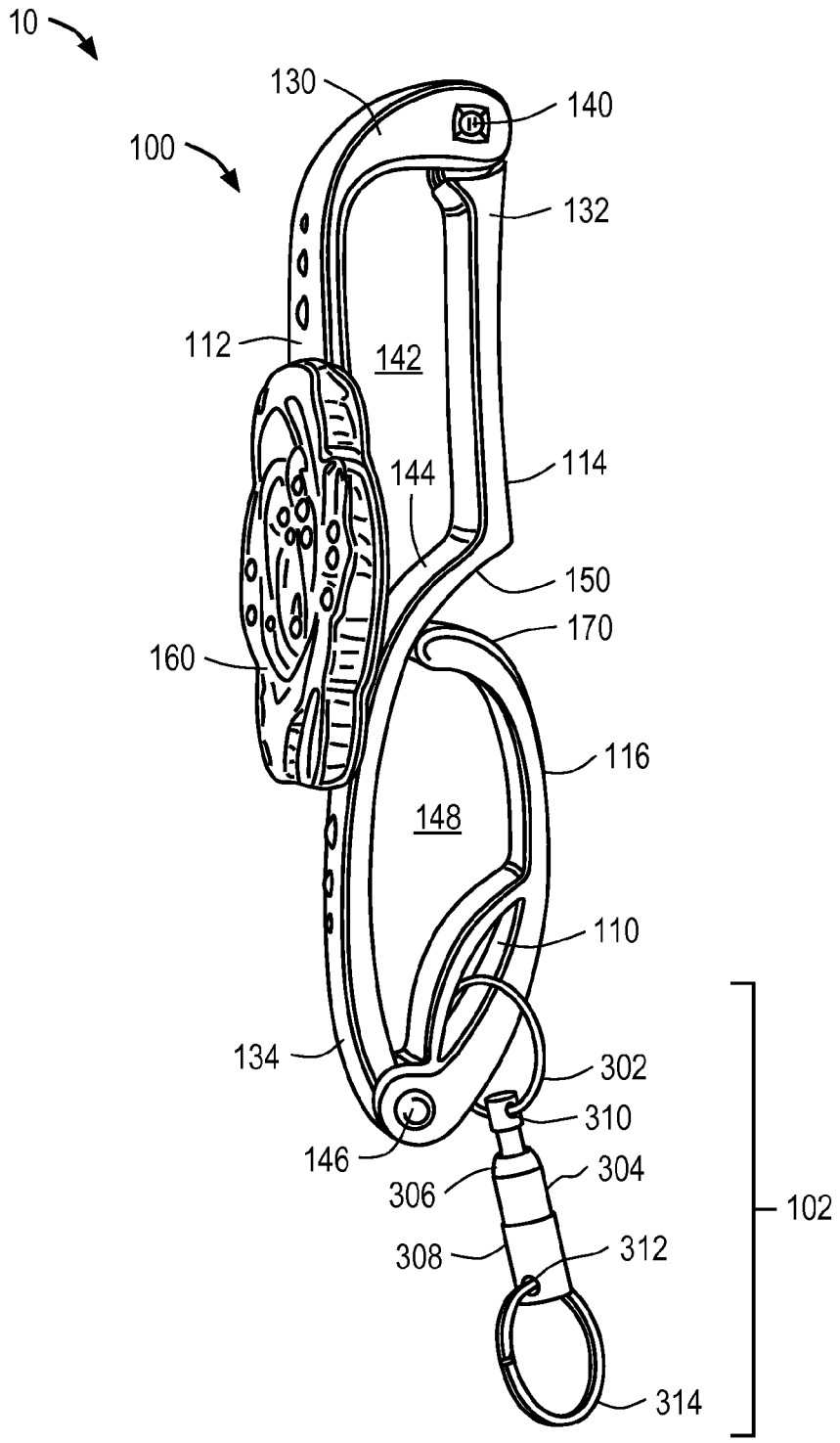
FIG. 3 is a front perspective view of a second combination purse hanger and object retainer in accordance with an embodiment of the present disclosure.

Referring to FIG. 3, in some embodiments, the second element 102 of the combination purse hanger object finder 10 comprises a first ring 302 that is drawn through the closed form channel 110. The second element 102 further comprises a member 304 having a first portion 306 and a second portion 308. The first portion 306 is rotatable with respect to the second portion 308. The first portion 306 comprises a first eyelet 310 through which the first ring 302 is attached. The second portion 308 comprises a second eyelet 312. The second element 102 further comprises a second ring 314 that is drawn through the second eyelet 312.

Similar to FIG. 3, although not depicted, in some embodiments, the second element 102 of the combination purse hanger object finder 10 comprises a first ring that is drawn through the closed form channel 110. The second element 102 further comprises a second ring that is interlocked with the first ring. The second element 102 further comprises a member having a first portion and a second portion. The first portion is rotatable with respect to the second portion. The first portion comprises a first eyelet through which the second ring is drawn. The second portion comprises a second eyelet. The second element 102 further comprises a third ring, where the third ring is attached to the second eyelet.

In another aspect, similar to FIG. 3 but now shown, the second element 102 of the combination purse hanger object finder 10 comprises a first ring that is drawn through the closed form channel 110. The second element 102 comprises a closed form clasp or second ring (not shown) that is configured for selectively retaining at least one key or other type of object. In one such embodiment, the closed form clasp or second ring is rotatably fixed to a u-shaped element of the second element 102, where the u-shaped element is substantially permanently and flexibly engaged with the first ring. In another such embodiment, the closed form clasp or second ring is substantially permanently and flexibly engaged with the first ring. In another such embodiment, the closed form clasp or second ring is engaged with a closed form member, where the closed form member is substantially permanently and flexibly engaged with the first ring. In still another such embodiment, the closed form clasp or second ring is engaged with a closed form member, where the closed form member is a third ring that is substantially permanently and flexibly engaged with the first ring. In still another such embodiment, the closed form clasp or second ring is engaged with a chain, where the chain is substantially permanently and flexibly engaged with the first ring. In still another such embodiment, the closed form clasp or second ring is engaged with a first interlocking closed form element in a plurality of interlocking closed form elements, where a second interlocking closed form element in the plurality of interlocking closed form elements is substantially permanently and flexibly engaged with the first ring.

In another aspect, similar to FIG. 3 but now shown, the second element 102 of the combination purse hanger object finder 10 comprises a first chain that is drawn through the closed form channel 110. The second element 102 comprises a closed form clasp or first ring (not shown) that is configured for selectively retaining at least one key or other type of object. In one such embodiment, the closed form clasp or first ring is rotatably fixed to a u-shaped element of the second element 102, where the u-shaped element is substantially permanently and flexibly engaged with the first chain. In another such embodiment, the closed form clasp or first ring is substantially permanently and flexibly engaged with the first chain. In another such embodiment, the closed form clasp or first ring is engaged with a closed form member, where the closed form member is substantially permanently and flexibly engaged with the first chain. In still another such embodiment, the closed form clasp or first ring is engaged with a closed form member, where the closed form member is a second ring that is substantially permanently and flexibly engaged with the first chain. In still another such embodiment, the closed form clasp or first ring is engaged with a second chain, where the second chain is substantially permanently and flexibly engaged with the first chain. In still another such embodiment, the closed form clasp or first ring is engaged with a first interlocking closed form element in a plurality of interlocking closed form elements, where a second interlocking closed form element in the plurality of interlocking closed form elements is substantially permanently and flexibly engaged with the first chain.

In some embodiments, the second element 102 comprises a first ring that selectively retains a key, where the first ring is drawn through the closed form channel 110.

Referring to FIG. 1, in some embodiments, the end portion 130 of the first terminal member 112 comprises an enlarged region (not shown) that serves as an ornament mounting pad for affixation of a container, flashlight or ornament. In some embodiments, there is no enlarged region and the container, flashlight or ornament is affixed directly onto the end portion 130 of the first terminal member 112.

Figure 4:
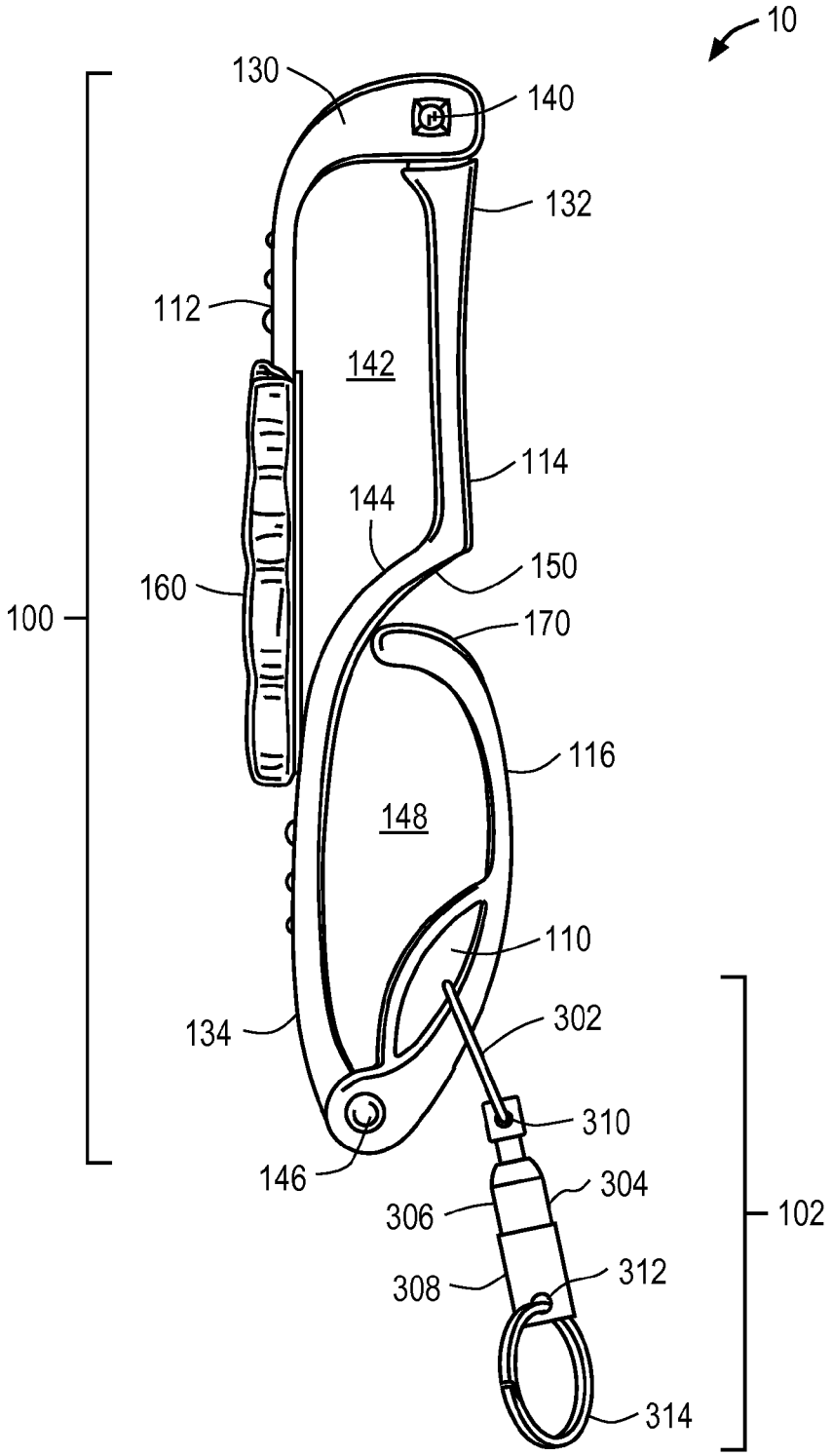
FIG. 4 is a side view of the combination purse hanger and object retainer of FIG. 3 in accordance with an embodiment of the present disclosure.

FIG. 4 illustrates a side view of the combination purse hanger and object finder of FIG. 3.

As illustrated in FIGS. 1-4, the first terminal member 112 and the first end 132 of the intermediate member 114 are connected by a first swivel axis 140 thereby defining a first interior region 142 between the first terminal member and the first end of the intermediate member. The first swivel axis permits the first terminal member to swivel between (i) a first closed position in which the first terminal member adjoins a first side of the intermediate member and (ii) a first open position in which the first terminal member is swiveled away from the first side of the intermediate member. The end portion 130 and the intermediate member 114 are configured to allow the combination purse hanger and object finder 10 to hang or clasp an edge (not shown). In some embodiments, the end portion 130 and the intermediate member 114, together with first swivel axis 140, are configured so that a force of between 1 dyne and 2000 dynes is required to remove the combination purse hanger and object finder 10 from an edge of a bag-like purse at a time when the first interior region 142 is used to hang or clasp the combination purse hanger and object finder 10 to the edge. In some embodiments, the end portion 130 and the intermediate member 114, together with first swivel axis 140, are configured so that a force of between 1 dyne and 1000 dynes is required to remove the combination purse hanger and object finder 10 from the edge of a bag-like purse at a time when the first interior region 142 is used to hang or clasp the combination purse hanger and object finder 10 to the edge.

In some embodiments, the end portion 130 and the intermediate member 114, together with first swivel axis 140, are configured so that a force of between 1 dyne and 500 dynes is required to remove the combination purse hanger and object finder 10 from the edge of a bag-like purse at a time when the first interior region 142 is used to hang or clasp the combination purse hanger and object finder 10 to the edge. In some embodiments, the end portion 130 and the intermediate member 114, together with first swivel axis 140, are configured so that a force of between 1 dyne and 250 dynes is required to remove the combination purse hanger and object finder 10 from the edge of a bag-like purse at a time when the first interior region 142 is used to hang or clasp the combination purse hanger and object finder 10 to the edge. In some embodiments, the end portion 130 and the intermediate member 114, together with first swivel axis 140, are configured so that a force of between 100 dynes and 2000 dynes is required to remove the combination purse hanger and object finder 10 from the edge of a bag-like purse at a time when the first interior region 142 is used to hang or clasp the combination purse hanger and object finder 10 to the edge. In some embodiments, the end portion 130 and the intermediate member 114, together with first swivel axis 140, are configured so that a force of between 100 dynes and 1000 dynes is required to remove the combination purse hanger and object finder 10 from the edge of a bag-like purse at a time when the first interior region 142 is used to hang or clasp the combination purse hanger and object finder 10 to the edge. In some embodiments, the end portion 130 and the intermediate member 114, together with first swivel axis 140, are configured so that a force of between 100 dynes and 500 dynes is required to remove the combination purse hanger and object finder 10 from the edge of a bag-like purse at a time when the first interior region 142 is used to hang or clasp the combination purse hanger and object finder 10 to the edge. In some embodiments, the end portion 130 and the intermediate member 114, together with first swivel axis 140, are configured so that a force of between 100 dynes and 250 dynes is required to remove the combination purse hanger and object finder 10 from the edge of a bag-like purse at a time when the first interior region 142 is used to hang or clasp the combination purse hanger and object finder 10 to the edge.

In some embodiments, the end portion 130 and the intermediate member 114, together with first swivel axis 140, are configured so that a force of between 1 dyne and 2000 dynes, between 1 dyne and 1000 dynes, between 1 dyne and 500 dynes, between 1 dyne and 250 dynes, between 0.1 dynes and 2000 dynes, between 0.1 dynes and 1000 dynes, between 0.1 dynes and 500 dynes, between 0.1 dynes and 250 dynes, between 100 dynes and 2000 dynes, between 100 dynes and 1000 dynes, between 100 dynes and 500 dynes, between 100 dynes and 250 dynes, between 500 dynes and 5000 dynes, between 500 dynes and 10000 dynes, between 500 dynes and 20000 dynes, between 500 dynes and 25000 dynes, between 0.1 dynes and 200 dynes, between 0.1 dynes and 100 dynes, between 0.1 dynes and 50 dynes, or between 0.1 dynes and 25 dynes is required to remove the combination purse hanger and object finder 10 from the edge of a bag-like purse at a time when the first interior region 142 is used to hang or clasp the combination purse hanger and object finder 10 to the edge.

In the drawings, the container, flashlight or ornament 160 is depicted as an ornament, in particular, a flower-like shape. As shown in the drawings, the ornament is arranged to face away from the first interior region 142 with its back portion preferably fixed to the end portion 130 of the first terminal member 112 by solder or the like. In some embodiments, the back portion of the container, flashlight or ornament is affixed directly onto the end portion 130 of the first terminal member 112. As used herein, an ornament is a solid object as opposed to a chain or a rope. In some embodiments, the ornament comprises an artificial or a real gem.

In typical embodiments, first terminal member 112, intermediate member 114 and second terminal member 116 are each slender so that they can be easily gripped and removed from a bag-like container such as a purse. Any slender shape form that enables the easy removal of the combination purse hanger and object finder 10 from a bag-like purse is within the scope of the present disclosure. For example, first terminal member 112, intermediate member 114 and/or second terminal member 116 can be flattened metal or other flat elements. In another example, in some embodiments, first terminal member 112, intermediate member 114 and/or second terminal member 116 has a flat rod-like shape characterized by a cross-section having first and second orthogonal dimensions in which the first dimension defines the thickness of the first terminal member 112, intermediate member 114 and/or second terminal member 116 and is between 0.01 cm and 0.5 cm and the second dimension defines the width and is between 0.1 cm and 2 cm. In another example, in some embodiments, first terminal member 112, intermediate member 114 and/or second terminal member 116 has a flat rod-like shape characterized by a cross-section having first and second orthogonal dimensions in which the first dimension defines the thickness and is between 0.05 cm and 0.8 cm and the second dimension defines the width and is between 0.2 cm and 3 cm.

In some embodiments, the first terminal member 112, intermediate member 114 and/or second terminal member 116 is characterized by a cross-sectional bounding shape that is circular. In some embodiments, the first terminal member 112, intermediate member 114 and/or second terminal member 116 is characterized by a cross-sectional bounding shape that is ovoid. In some embodiments, the first terminal member 112, intermediate member 114 and/or second terminal member 116 is characterized by a cross-sectional bounding shape having one or more smooth curved surfaces or a splice of one or more smooth curved surfaces. In some embodiments, the first terminal member 112, intermediate member 114 and/or second terminal member 116 is characterized by a cross-sectional bounding shape having an arcuate edge. In some embodiments, the first terminal member 112, intermediate member 114 and/or second terminal member 116 is characterized by different cross-sectional bounding shapes at different portions of the first terminal member 112, intermediate member 114 and/or second terminal member 116.

In some embodiments, the end portion 130 and a portion of the first side 144 of the intermediate member 114 are magnetized thereby causing the end portion 130 and the first side 144 of the intermediate member 114 to grasp onto an edge (e.g., side pocket or main zipper portion) of a bag. In some embodiments a terminal portion 170 of the second terminal member 116 and a portion of the second side 150 of the intermediate member 114 are magnetized thereby causing the terminal portion 170 and the second side 150 of the intermediate member 114 to touch each other and to prevent the release of a strap of the bag.

Figure 5:
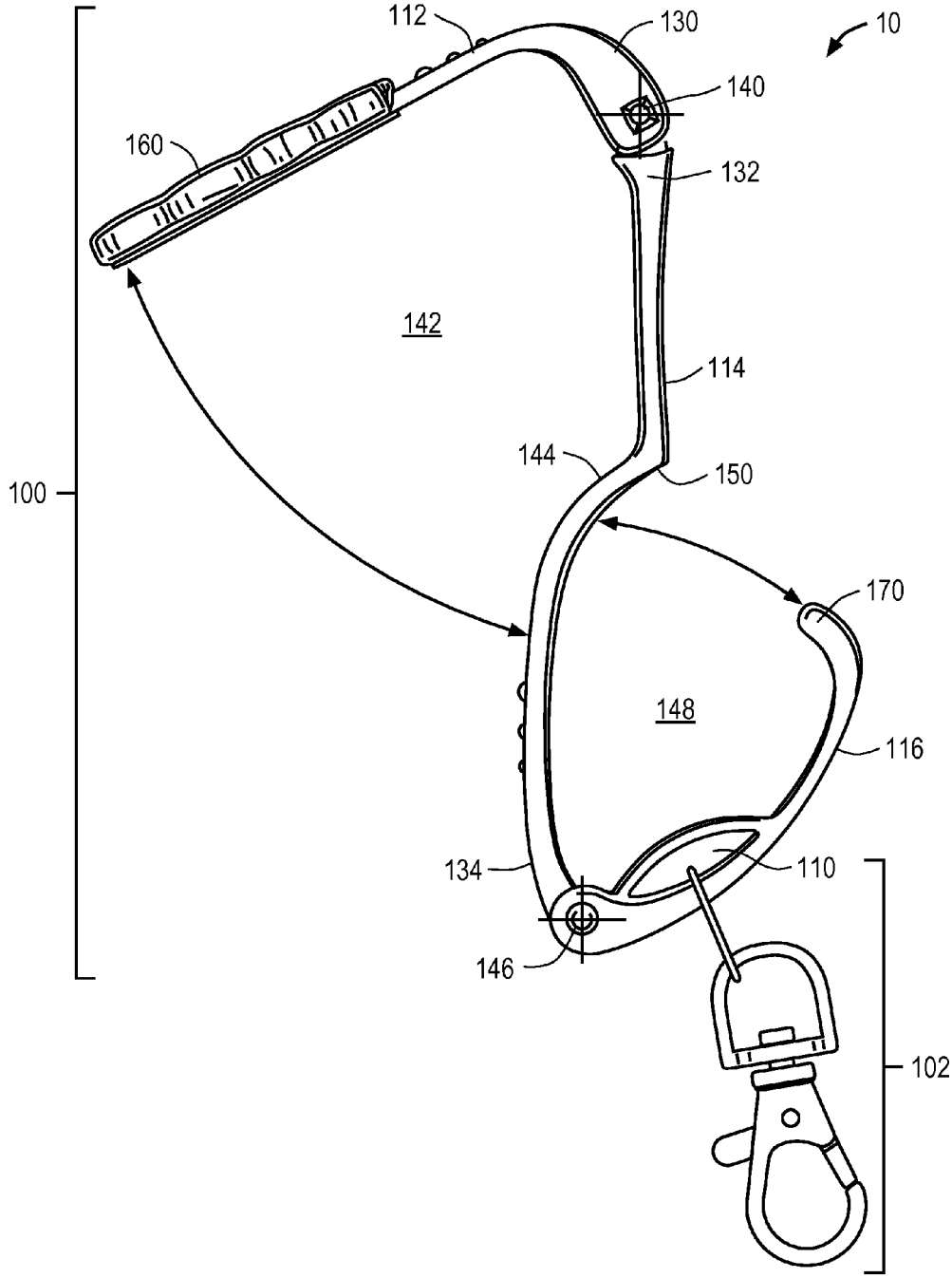
FIG. 5 illustrates how the combination purse hanger and object retainer swivels out on two discrete axes in order to hang from a table or other surface and support a purse or other form of bag in accordance with an embodiment of the present disclosure.

Turning to FIG. 5, the first and second open positions are illustrated, whereas FIGS. 1 through 4 illustrate the first and second closed positions. Thus, comparing FIGS. 1-4 to FIG. 5, it is seen how the first terminal member 112 and the first end of the intermediate member 132 are connected by a first swivel axis 140 thereby defining a first interior region 142 between the first terminal member and the first end of the intermediate member, with the first swivel axis 140 permitting the first terminal member 112 to swivel between (i) a first closed position (FIGS. 1-4) in which the first terminal member adjoins a first side 144 of the intermediate member and (ii) a first open position (FIG. 5) in which the first terminal member 112 is swiveled away from the first side 144 of the intermediate member. Moreover, comparing FIGS. 1-4 to FIG. 5, it is seen how the second terminal member 116 and the second side 150 of the intermediate member 114 are connected by a second swivel axis 146 thereby defining a second interior region 148 between the second terminal member and the second end of the intermediate member. The second swivel axis permits the second terminal member to swivel between (i) a second closed position in which the second terminal member adjoins a second side of the intermediate member (FIGS. 1-4) to (ii) a second open position (FIG. 5) in which the second terminal member is swiveled away from the second side of the intermediate member Another aspect provides a method for retaining at least one key by a second element 102 of an apparatus 10 that comprises the second element 102, a first element 100 and a connecting element (e.g., first ring, chain or string) 104. The second element 100 is configured for selectively retaining at least one key. The first element 100 comprises a first terminal member 112 having an end portion, an intermediate member 114 having a first end 132 and a second end 134, and a second terminal member 116 having a closed form channel 110, wherein the connecting element 104 is drawn through the closed form channel 110 and substantially permanently and flexibly engages the second element 102 to the first element 100. The first terminal member 112 and the first end 132 of the intermediate member 114 are connected by a first swivel axis 140 thereby defining a first interior region 142 between the first terminal member 112 and the first end 132 of the intermediate member 114. The second terminal member 116 and the second end 132 of the intermediate member 114 are connected by a second swivel axis 146 thereby defining a second interior region 148 between the second terminal member 116 and the second end 132 of the intermediate member 114. The end portion 130 of the first terminal member 112 is affixed to a container, flashlight or ornament 160. In the method, the first swivel axis 140 is used to swivel the first terminal member 112 from a first closed position (FIGS. 1-4), in which the first terminal member 112 adjoins a first side 144 of the intermediate member 114, to a first open position (FIG. 5) in which the first terminal member is swiveled away from the first side of the intermediate member. Further, a surface is engaged with the first terminal member 112, on the side of the first terminal member that faces away from the container, flashlight, or ornament, when the first swivel axis 140 is in the first open position, thereby supporting the apparatus 10. The method further comprises using the second swivel axis 146 to swivel the second terminal member 116 from a second closed position (FIGS. 1-4), in which the second terminal member adjoins a second side 150 of the intermediate member 114, to a second open position (FIG. 5), in which the second terminal member 116 is swiveled away from the second side of the intermediate member, where the first side 144 of the intermediate member opposes the second side 150. The method further comprises placing a strap or handle of a hanging bag or purse through the second interior portion 148 when the second swivel axis is in the second open position. The method further comprises using the second swivel axis to swivel the second terminal member from the second open position (FIG. 5) to the second closed position (FIGS. 1-4) thereby supporting the hanging bag or purse.

Figure 9A:
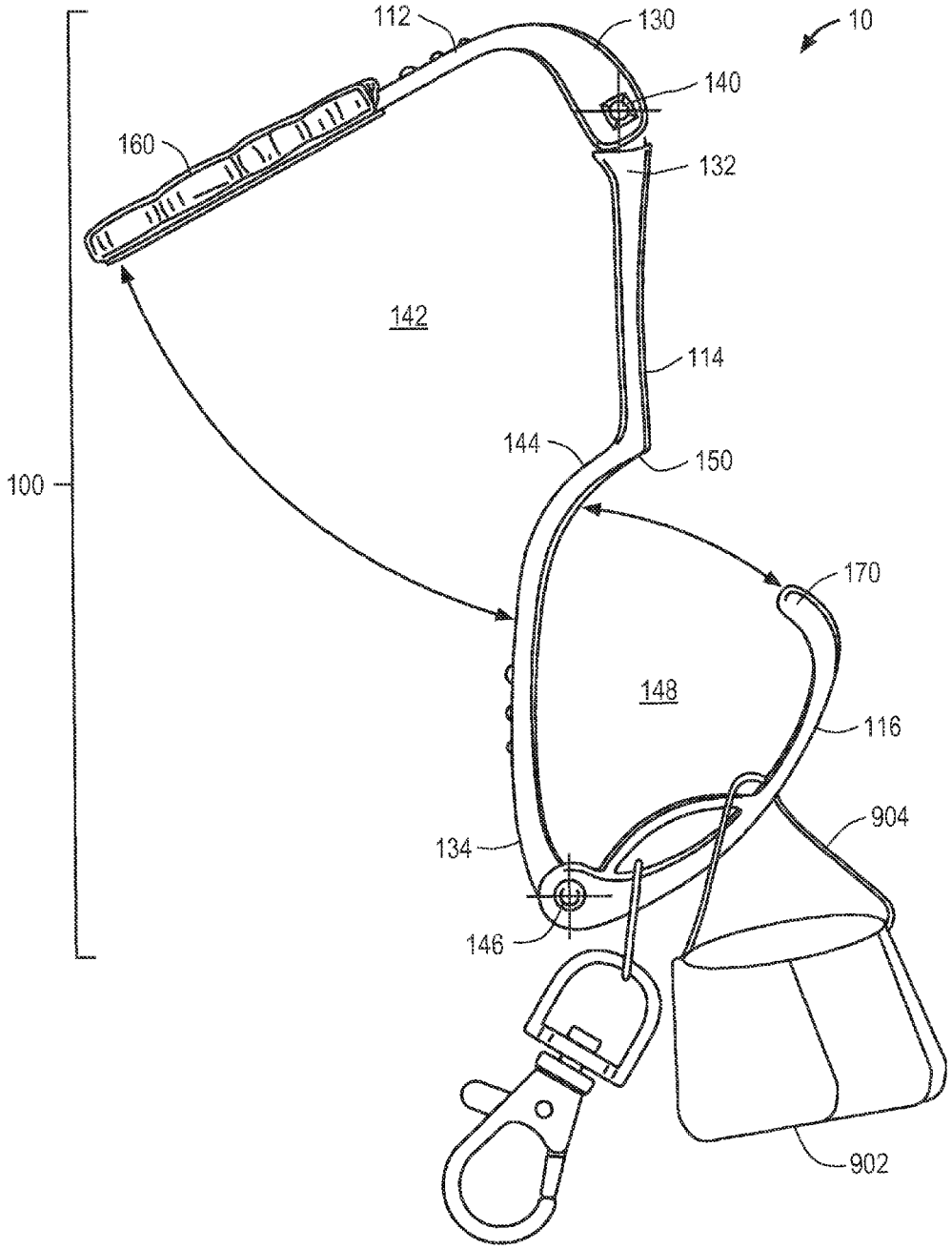
FIG. 9A shows an exemplary representation of a hanging bag placed in the second interior portion.
Figure 9B:
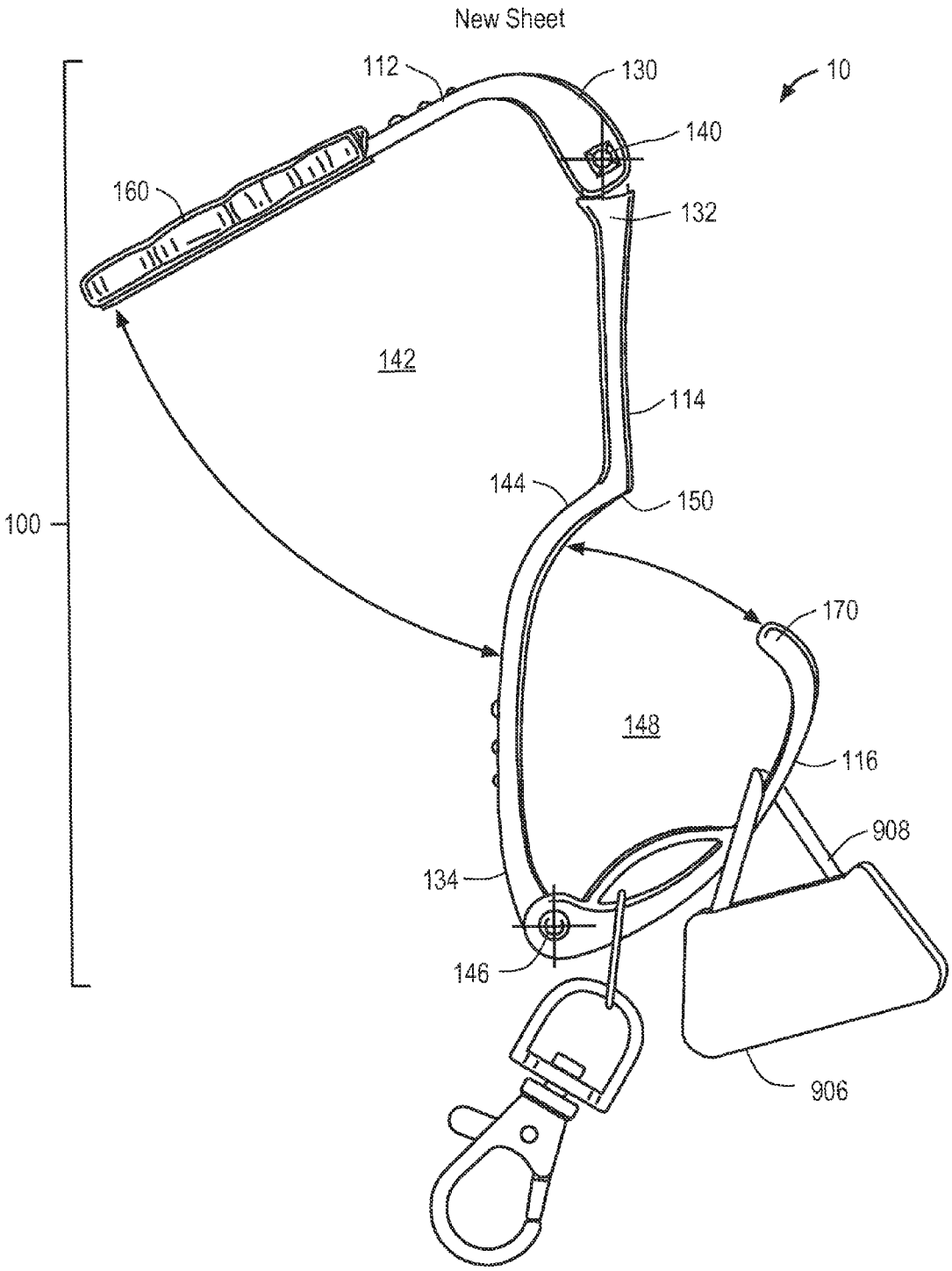
FIG. 9B shows an exemplary representation of a purse placed in the second interior portion.

FIG. 9A shows an exemplary representation of a hanging bag 902 with a strap 904 placed in the second interior portion 148. FIG. 9B shows an exemplary representation of a purse 906 with a handle 908 placed in the second interior portion 148.

REFERENCES CITED AND ALTERNATIVE EMBODIMENTS

All references cited herein are incorporated herein by reference in their entirety and for all purposes to the same extent as if each individual publication or patent or patent application was specifically and individually indicated to be incorporated by reference in its entirety for all purposes.

Many modifications and variations of this invention can be made without departing from its spirit and scope, as will be apparent to those skilled in the art. The specific embodiments described herein are offered by way of example only. The embodiments were chosen and described in order to best explain the principles of the invention and its practical applications, to thereby enable others skilled in the art to best utilize the invention and various embodiments with various modifications as are suited to the particular use contemplated. The invention is to be limited only by the terms of the appended claims, along with the full scope of equivalents to which such claims are entitled.

What is claimed:

1. A combination purse hanger and object retainer comprising:

A) a first element, the first element comprising:

i) a first terminal member having an end portion, ii) an intermediate member having a first end and a second end, and iii) a second terminal member having a closed form channel;

B) a second element configured for selectively retaining at least one object; and C) a connecting element drawn through said closed form channel and substantially permanently and flexibly engaging the second element to the first element, wherein the first terminal member and the first end of the intermediate member are connected by a first swivel axis thereby defining a first interior region between the first terminal member and the first end of the intermediate member, wherein the first swivel axis permits the first terminal member to swivel between (i) a first closed position in which the first terminal member adjoins a first side of the intermediate member and (ii) a first open position in which the first terminal member is swiveled away from the first side of the intermediate member, the second terminal member and the second end of the intermediate member are connected by a second swivel axis thereby defining a second interior region between the second terminal member and the second end of the intermediate member, wherein the second swivel axis permits the second terminal member to swivel between (i) a second closed position in which the second terminal member adjoins a second side of the intermediate member to (ii) a second open position in which the second terminal member is swiveled away from the second side of the intermediate member, wherein the first side opposes the second side, the first terminal member and the first end of the intermediate member are configured to allow the first interior region to hang from or clasp an edge when the first swivel axis is in the first closed position, the first terminal member and the first end of the intermediate member are configured to allow the first terminal member to engage a surface when the first swivel axis is in the first open position, thereby supporting the combination purse hanger and object retainer, the second terminal member and the second end of the intermediate member are configured to allow the second interior region to support a hanging bag or purse when the second swivel axis is in the second closed position, and the end portion of the first terminal member is affixed to a container, flashlight or ornament.

2. The combination purse hanger and object retainer of claim 1, wherein the first terminal member is affixed to the container, and wherein the container is directly and permanently fixed to the end portion of the first terminal member so that a first face of the container is exposed, wherein the container is arranged so that the first face of the container faces away from the first interior region.

3. The combination purse hanger and object retainer of claim 2, wherein the end portion of the first terminal member comprises an enlarged portion and wherein a second face of the container is directly and permanently fixed to the enlarged portion.

4. The combination purse hanger and object retainer of claim 3, wherein the enlarged portion comprises a solid face to which a portion of the second face of the container is directly and permanently fixed.

5. The combination purse hanger and object retainer of claim 3, wherein the enlarged portion comprises a solid face to which a portion of the second face is soldered.

6. The combination purse hanger and object retainer of claim 1, wherein the first terminal member is affixed to a container, wherein a second face of the container is directly and permanently fixed to the end portion of the first terminal member.

7. The combination purse hanger and object retainer of claim 1, wherein the first terminal member is affixed to a container, wherein a second face of the container is soldered to the end portion of the first terminal member.

8. The combination purse hanger and object retainer of claim 1, wherein the first terminal member, the intermediate member, the second terminal member, and the second element each independently comprise a material selected from the group consisting of metal and plastic.

9. The combination purse hanger and object retainer of claim 1, wherein the first terminal member, the intermediate member, the second terminal member, and the second element are each independently comprise gold, silver, steel, nickel, aluminum, an alloy thereof, or any combination thereof.

10. The combination purse hanger and object retainer of claim 1, wherein the first terminal member, the intermediate member, the second terminal member, and the second element are each made of metal.

11. The combination purse hanger and object retainer of claim 1, wherein the first terminal member, the intermediate member, the second terminal member, or the second element comprises urethane polymer, an acrylic polymer, a fluoropolymer, polybenzamidazole, polyimide, polytetrafluoroethylene, polyetheretherketone, polyamide-imide, glass-based phenolic, polystyrene, cross-linked polystyrene, polyester, polycarbonate, polyethylene, polyethylene, acrylonitrile-butadiene-styrene, polytetrafluoro-ethylene, polymethacrylate, nylon 6,6, cellulose acetate butyrate, cellulose acetate, rigid vinyl, plasticized vinyl, or polypropylene.

12. The combination purse hanger and object retainer of claim 1, wherein the edge is an upper edge of a side panel of a purse, a backpack, or a briefcase.

13. The combination purse hanger and object retainer of claim 1, wherein said first element and said second element are configured so that when the first element is retrieved from the edge, the second element is necessarily retrieved.

14. The combination purse hanger and object retainer of claim 1, wherein a force of between 1 dyne and 2000 dynes is required to remove the combination purse hanger and object retainer from the edge at a time when the first swivel axis is in the first closed position.

15. The combination purse hanger and object retainer of claim 1, wherein a force of between 1 dyne and 1000 dynes is required to remove the combination purse hanger and object retainer from said edge at a time when said first swivel axis is in the first closed position.

16. The combination purse hanger and object retainer of claim 1, wherein a force of between 1 dyne and 500 dynes is required to remove the combination purse hanger and object retainer from said edge at a time when said first swivel axis is in the first closed position.

17. The combination purse hanger and object retainer of claim 1, wherein a force of between 1 dyne and 250 dynes is required to remove the combination purse hanger and object retainer from said edge at a time when said first swivel axis is in the first closed position.

18. The combination purse hanger and object retainer of claim 1, wherein a force of between 100 dynes and 2000 dynes is required to remove the combination purse hanger and object retainer from said edge at a time when said first swivel axis is in the first closed position.

19. The combination purse hanger and object retainer of claims 1, wherein a force of between 100 dynes and 1000 dynes is required to remove the combination purse hanger and object retainer from said edge at a time when said first swivel axis is in the first closed position.

20. The combination purse hanger and object retainer of claim 1, wherein a force of between 100 dynes and 500 dynes is required to remove the combination purse hanger and object retainer from said edge at a time when said first swivel axis is in the first closed position.

21. The combination purse hanger and object retainer of claim 1, wherein a force of between 100 dynes and 250 dynes is required to remove the combination purse hanger and object retainer from said edge at a time when said first swivel axis is in the first closed position.

22. The combination purse hanger and object retainer of claim 1, wherein the end portion of the first terminal member is affixed to an ornament, and wherein the ornament comprises an artificial or a real gem.

23. The combination purse hanger and object retainer of claim 1, wherein the second element comprises a closed form clasp or second ring that is configured for selectively retaining at least one object.

24. The combination purse hanger and object retainer of claim 23, wherein the closed form clasp or second ring is rotatably fixed to a u-shaped element of said second element, wherein the u-shaped element is substantially permanently and flexibly engaged with the connecting element.

25. The combination purse hanger and object retainer of claim 23, wherein the closed form clasp or second ring is substantially permanently and flexibly engaged with the connecting element.

26. The combination purse hanger and object retainer of claim 23, wherein the closed form clasp or second ring is engaged with a closed form member, wherein the closed form member is substantially permanently and flexibly engaged with the connecting element.

27. The combination purse hanger and object retainer of claim 23, wherein the closed form clasp or second ring is engaged with a closed form member, wherein the closed form member is a third ring that is substantially permanently and flexibly the connecting element.

28. The combination purse hanger and object retainer of claim 23, wherein the closed form clasp or second ring is engaged with a first interlocking closed form element in a plurality of interlocking closed form elements, wherein a second interlocking closed form element in the plurality of interlocking closed form elements is substantially permanently and flexibly engaged with the connecting element.

29. The combination purse hanger and object retainer of claim 28, wherein a closed form element in the plurality of closed form elements is a ring, an oval, a polygon, or a star-shape.

30. The combination purse hanger and object retainer of claim 1, wherein all or a portion of the first terminal member, the intermediate member, the second terminal member or the second element is electroplated.

31. The combination purse hanger and object retainer of claim 1, wherein the at least one object is a key, a pen, a flashlight, a magnifying glass, an eye piece, a coin purse, a USB key, a key fob, an access card key, a fast pass, a credit card and a bank card.

32. A method comprising:

a) retaining at least one object by a second element of an apparatus that comprises said second element, a first element and a connecting element, wherein the second element is configured for selectively retaining at least one object, wherein (i) said first element comprises a first terminal member having an end portion, an intermediate member having a first end and a second end, and a second terminal member having a closed form channel, wherein the connecting element is drawn through the closed form channel and substantially permanently and flexibly engages the second element to the first element, wherein the first terminal member and the first end of the intermediate member are connected by a first swivel axis thereby defining a first interior region between the first terminal member and the first end of the intermediate member;

the second terminal member and the second end of the intermediate member are connected by a second swivel axis thereby defining a second interior region between the second terminal member and the second end of the intermediate member, and the end portion of the first terminal member is affixed to a container, flashlight or ornament;

b) using the first swivel axis to swivel the first terminal member from a first closed position, in which the first terminal member adjoins a first side of the intermediate member, to a first open position in which the first terminal member is swiveled away from the first side of the intermediate member;

c) engaging a surface with the first terminal member when the first swivel axis is in the first open position, thereby supporting the apparatus;

d) using the second swivel axis to swivel the second terminal member from a second closed position, in which the second terminal member adjoins a second side of the intermediate member, to a second open position, in which the second terminal member is swiveled away from the second side of the intermediate member, wherein the first side opposes the second side;

e) placing a strap or handle of a hanging bag or purse in the second interior portion when then the second swivel axis is in the second open position; and f) using the second swivel axis to swivel the second terminal member from the second open position to the second closed position thereby supporting the hanging bag or purse.

* * * * *